United States Patent [19]

Schilling et al.

[11] Patent Number: 4,915,621

[45] Date of Patent: Apr. 10, 1990

[54] GAS BURNER WITH COOLING PIPES

[75] Inventors: Jürgen Schilling; Thomas Pieper, both of Wermelskirchen, Fed. Rep. of Germany

[73] Assignee: Joh. Vaillant GmbH und Co., Remscheid, Fed. Rep. of Germany

[21] Appl. No.: 102,566

[22] PCT Filed: Nov. 17, 1986

[86] PCT No.: PCT/DE86/00468

§ 371 Date: Aug. 20, 1987

§ 102(e) Date: Aug. 20, 1987

[87] PCT Pub. No.: WO87/03068

PCT Pub. Date: May 21, 1987

[30] Foreign Application Priority Data

Nov. 15, 1985 [DE] Fed. Rep. of Germany ..... 3541088

[51] Int. Cl.[4] ..... F23D 13/12

[52] U.S. Cl. ..... 431/350; 431/2; 431/347; 431/326

[58] Field of Search ..... 431/2, 8, 12, 350, 326, 431/347, 233, 244, 247; 126/106, 109; 122/367 C

[56] References Cited

U.S. PATENT DOCUMENTS

| | | | |
|---|---|---|---|
| 1,003,180 | 9/1911 | Hall | 431/244 |
| 1,315,993 | 9/1919 | Shepardson | 431/244 X |
| 1,532,612 | 4/1925 | Taylor | 431/350 |
| 2,612,890 | 10/1952 | Harsh | 126/106 X |
| 2,807,257 | 9/1957 | Collins | 126/109 |
| 4,050,877 | 9/1977 | Craig et al. | 431/351 X |
| 4,323,343 | 4/1982 | Reed et al. | 431/350 X |
| 4,525,141 | 6/1985 | Dewerth | 431/347 |
| 4,616,994 | 10/1986 | Tomlinson | 431/350 X |
| 4,652,236 | 3/1987 | Viessmann | 431/350 |

FOREIGN PATENT DOCUMENTS

| | | |
|---|---|---|
| 8507804 | 5/1985 | Fed. Rep. of Germany . |
| 8605274 | 5/1986 | Fed. Rep. of Germany . |
| 2506910 | 12/1982 | France . |

*Primary Examiner*—Carl D. Price

*Attorney, Agent, or Firm*—Horst M. Kasper

[57] ABSTRACT

A gas burner comprising a heating gas pipe, the wall of which is traversed by at least one group of longitudinally arranged outlet nozzles. These groups of nozzles (2 or 3) are connected with at least one conduit (5) for a heat accumulating agent which is parallel to the heating gas pipe (1).

11 Claims, 1 Drawing Sheet

GAS BURNER WITH COOLING PIPES

BACKGROUND OF THE INVENTION

1. Field of the Invention

The invention relates to a gas-heated heat exchanger with a pipe feeding heating gas, where the wall of the pipe is interspersed by at least a longitudinally running bundle of gas exit nozzles.

2. Description of the Related Art including information disclosed under 37 CRF §§ 1.97–1.99

It is known that the nitrogen oxide ($NO_x$) contents of exhaust gases can be influenced by changing three essential parameters, that is, of temperature, partial pressure of oxygen, and time.

It is further known that the height and distribution of the temperature can be controlled by cooling of the burner chamber walls or the burner plate.

However, if one considers the temperatures within the individual flame, then it can be recognized that the maximum temperature is located neither at the base of the flame nor, in case of multi-flame burners, at the edge of a flame zone, but is located in each case within the upper third of each individual flame.

Rods made of a refractory or thermally stable material can be positioned such at the burner next to the burner flames that they deflect the heat for a temperature balancing from the hot zones into cooler regions.

In fact, this achieves a decrease in the nitrogen oxide ($NO_x$) content of the exhaust gases, but in case of cramped space situations, the flames are disturbed such that the carbon monoxide (CO) emission increases. The rods should be provided at a larger distance from the flames, whereby, in fact, the carbon monoxide content would be reduced but the nitrogen oxide content would increase.

SUMMARY OF THE INVENTION

It is an object of the invention to provide a heat exchanger of the kind initially designated such that a distribution of the heat as uniformly as possible can be achieved and, in fact, by cooling in that region of the burner flames which is the hottest, i.e. about the upper third of the flames.

According to the invention, this problem is resolved by arranging in a heat exchanger of this kind the bundles or longitudinal sequences of gas exit openings on two sides of a pipe line, in each case, which serves for conducting a heat-storing medium, which pipe line is disposed parallel to the pipe carrying the heat-carrying gas.

This structure is associated in particular with the advantage that such pipe lines, serving for cooling purposes, can be attached at an advantageously selectable optimum distance from the outside of the heating gas-carrying pipe with solid supports at the wall of the heating gas-carrying pipe. The pipe line, serving for cooling purposes, can be brought into an optimum position relative to the flames forming at these nozzles, that is, to about the level of the upper third of these flames.

Further advantages resulting from this structure include a decrease of the gas volume of heating gas and primary air or, respectively, secondary air, a decrease of the flow resistance and a more compact structure of the flames. Furthermore, there is provided a decrease of the dwelling time, a better mixture of the exhaust gases, a better burn-out, a high flame stability and, finally, a decrease both of the nitrogen oxide ($NO_x$) contents as well as of the carbon monoxide (CO) contents of the exhaust gases.

BRIEF DESCRIPTION OF THE DRAWING

In detail, there is shown in

DESCRIPTION OF THE PREFERRED EMBODIMENTS

Figure 1:
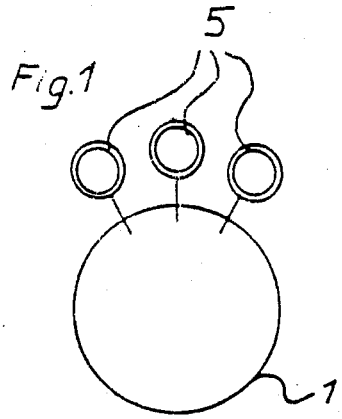
FIG. 1, the heat exchanger in cross-section

The heat exchanger comprises at least one heating gas-conducting pipe 1. The wall of the heating gas-conducting pipe 1 is interspersed by several bundles of gas exit openings 2 or, respectively, 3. The nozzles of so-called maintaining flames are designated with 2, and the nozzles of the main flames are designated with 3. Fixed points 4 at the front ends of the pipe connections facilitate the exact connection to a pipe strand.

Conduction pipes for conducting the heat-storing medium, for example water, are designated with 5. According to the embodiment illustrated, three such conduction pipes 5 are provided, which are attached, by way of any desired form of supports 6, at the wall of the heating gas-conducting pipe 1 in an optimum distance from this wall for the cooling in the upper third of the burner flames.

Figure 3:
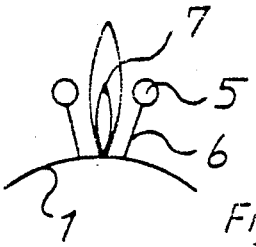
FIG. 3, there is illustrated the invention solution in principle.

As is shown in FIG. 3, the gas exit nozzles 2 and 3 are disposed, in each case, on two sides of a pipe line 5. In fact, the distance of the pipe line 5 from the pipe 1 is to be dimensioned such that it corresponds approximately to the distance of the core of the heating flames 7 from the pipe 1 in order to assure an optimum heat exchange.

Figure 4:
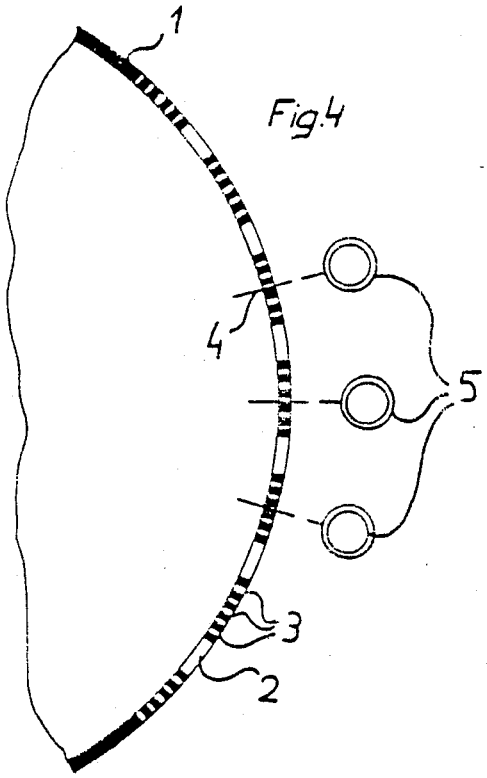
FIG. 4, there is illustrated an enlarged view of the burner pipe.
Figure 2:
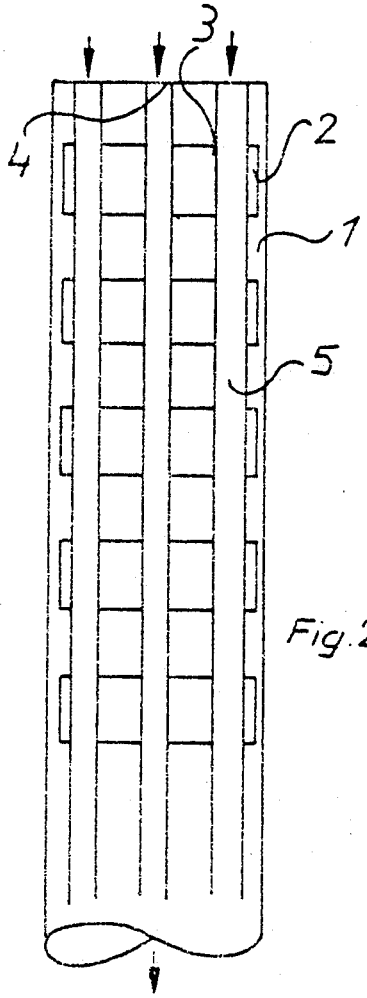
FIG. 2, a plan view of the heat-exchanger.

As illustrated in FIG. 4, longitudinally spaced areas include first gas exit nozzles (2) and second gas exit nozzles (3). The gas exit nozzles (3) are relatively small compared to the first gas exit nozzles (2). The first gas exit nozzles (2) and the second gas exit nozzles (3) are interspaced in a transverse direction with respect to the primary longitudinal axis of the conducting pipe (1).

Of course, the cross-section of both the pipe 1, conducting the heating gas, as well as of the pipe lines 5, conducting the thermal exchange medium, can be modified as desired within the scope of the invention without deviating from the basic principle of the invention.

I claim:

1. A gas-heated heat exchanger with a cylindrical pipe, conducting combustible gas;

wherein longitudinally spaced areas of the cylindrical pipe include a first longitudinally running group of first gas exit nozzles (2) and a second longitudinally running group of second gas exit nozzles (3); wherein the second gas exit nozzles (3) are relatively small compared to the first gas exit nozzles (2);

wherein the first gas exit nozzles (2) and the second gas exit nozzles (3) are interspaced in a transverse direction with respect to the primary longitudinal axis of the conducting pipe (1);

wherein such first longitudinally running group of gas exit nozzles (2 or, respectively, 3) are disposed on two sides relative to a radius of said cylindrical pipe extending from the pipe to a pipe line, wherein said pipe line (5) is disposed parallel to the combustible gas-conducting pipe (1), wherein said pipe line (5) is disposed generally above the second group of nozzles of the combustible gas-conducting pipe, and wherein the pipe line (5) serves to conduct a heat-storing medium.

2. A gas-heated heat exchanger for withdrawal of thermal energy comprising a cylindrical pipe for conducting combustible gas having a first longitudinally running group of gas exit nozzles permeating the wall of the pipe;

a second longitudinally running group of gas exit nozzles; wherein the second gas exit nozzles are relatively small compared to the first gas exit nozzles;

wherein the first gas exit nozzles and the second gas exit nozzles are permeating the wall of the pipe and are interspaced in a transverse direction with respect to the primary longitudinal axis of the conducting pipe such as to be disposed circumferentially at a distance relative to the first longitudinally running group;

a pipe line running parallel to the combustible gas-conducting pipe and serving to conduct a heat-storing medium, where such first longitudinally running group of gas exit nozzles is disposed circumferentially on two sides of a radius of said cylindrical pipe extending from the pipe to the pipe line.

3. A gas-heated heat exchanger for withdrawal of thermal energy comprising a cylindrical pipe for conducting combustible gas having a wall;

a first longitudinally running sequence of first gas exit nozzles permeating the wall of the pipe;

a second longitudinally running sequence of second gas exit nozzles permeating the wall of the pipe, wherein the second gas exit nozzles are relatively small compared to the first gas exit nozzles, and wherein the sequence of first gas exit nozzles and the sequence of second gas exit nozzles are alternatingly interspaced in a transverse direction with respect to the primary longitudinal axis of the conducting pipe;

a pipe line running parallel to the combustible gas-conducting pipe and serving to conduct a fluid heat-storing medium, wherein at least one second longitudinal sequence of nozzles and the pipe line are generally disposed on a radial straight line relative to the longitudinal axis of the pipe.

4. The heat exchanger according to claim 2, wherein such second longitudinal sequence of nozzles is disposed below the pipe line and, as seen in a projection of the cylindrical pipe onto the level of the pipe line, said second longitudinal sequence of nozzles is substantially overlapping the pipe line.

5. The heat exchanger according to claim 2, wherein the pipe line is attached at a distance from the outside of the combustible gas-conducting pipe with supports at the wall of the combustible gas-conducting pipe.

6. The heat exchanger according to claim 5, wherein the pipe line is disposed at a radial distance from the combustible gas-conducting cylindrical pipe, parallel to the combustible gas-conducting cylindrical pipe, and between two longitudinal sequences of first nozzles.

7. The heat exchanger according to claim 3, wherein the heat-storing medium is water.

8. The heat exchanger according to claim 2, wherein the pipe line is disposed for cooling the upper third of burner flames fed with gaseous fuel from the first nozzles.

9. The heat exchanger according to claim 2, wherein two rows of first exit nozzles are disposed on two sides of the pipe line.

10. The heat exchanger according to claim 4, wherein the pipe line is attached at a distance from the outside of the combustible gas-conducting pipe with supports at the wall of the combustible gas-conducting pipe;

wherein the pipe line is disposed at a radial distance from the combustible gas-conducting cylindrical pipe, parallel to the combustible gas-conducting cylindrical pipe, and between two longitudinal sequences of first nozzles;

wherein the heat-storing medium is water;

wherein the pipe line is disposed for cooling the upper third of burner flames fed with gaseous fuel from the first nozzles.

11. A gas-heated heat exchanger with a cylindrical pipe, conducting combustible gas, where a wall of the pipe is permeated by first longitudinally running groups of first gas exit nozzles (2) and by second longitudinally running groups of second gas exit nozzles (3), wherein the second gas exit nozzles (3) are relatively small compared to the first gas exit nozzles (2), and wherein the first gas exit nozzles (2) and the second gas exit nozzles (3) are interspaced in a transverse direction with respect to the primary longitudinal axis of the conducting pipe (1); wherein some of the nozzles of each of said groups of said longitudinal groups of first gas exit nozzles (2) is disposed to a side of a pipe line (5) spaced adjacent to and running parallel with the combustible gas-conducting pipe, wherein the pipe line (5) serves to conduct a heat-storing medium.

* * * * *